US011105592B1

(12) United States Patent
Keeney et al.

(10) Patent No.: US 11,105,592 B1
(45) Date of Patent: Aug. 31, 2021

(54) ARROW WITH REDUCED DIAMETER

(71) Applicant: Barnett Outdoors, LLC, Tarpon Springs, FL (US)

(72) Inventors: Sean Keeney, New Port Richey, FL (US); Brady Arview, Bethalto, IL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 16/674,639

(22) Filed: Nov. 5, 2019

Related U.S. Application Data

(60) Provisional application No. 62/755,836, filed on Nov. 5, 2018.

(51) Int. Cl.
*F42B 6/06* (2006.01)
*F42B 6/04* (2006.01)

(52) U.S. Cl.
CPC ..... *F42B 6/06* (2013.01)

(58) Field of Classification Search
CPC ..... F42B 6/02; F42B 6/04; F42B 6/06
USPC ..... 473/578
See application file for complete search history.

(56) References Cited

U.S. PATENT DOCUMENTS 2,288,562 A * 6/1942 Birkhofer ..... F42B 6/04 473/586
4,305,588 A * 12/1981 Dodge ..... F42B 6/06 403/268
4,544,163 A * 10/1985 Scanlon ..... F42B 6/06 473/578
4,645,211 A * 2/1987 Beiter ..... F42B 6/06 473/578
4,874,180 A * 10/1989 Fingerson ..... F42B 6/04 473/578
5,067,731 A * 11/1991 Bickel ..... F42B 6/06 473/578
5,154,432 A * 10/1992 Saunders ..... F42B 6/06 473/578
5,465,979 A * 11/1995 Buhler ..... F42B 6/06 473/578
6,017,284 A * 1/2000 Giles ..... F42B 6/06 473/578
6,821,219 B2 * 11/2004 Thurber ..... F42B 6/04 473/578
6,932,728 B2 * 8/2005 Palomaki ..... F42B 6/04 473/578
7,189,170 B1 * 3/2007 Korsa ..... F42B 6/06 473/578
7,686,714 B2 * 3/2010 Smith ..... F42B 6/04 473/578
8,388,473 B2 * 3/2013 Smith ..... F42B 6/04 473/578
8,920,268 B2 * 12/2014 Boretto ..... F42B 6/04 473/578

(Continued)

*Primary Examiner* — Alexander R Niconovich
(74) *Attorney, Agent, or Firm* — Jones Walker LLP

(57) ABSTRACT

An arrow with a shaft having a reduced outer diameter. The outer diameter of the arrow shaft may be in the range of 0.231 to 0.274 inches. The arrow may also include an insert. The arrow may also include a nock. The nock may have an enlarged section including two opposing arms defining a recess for placement of the bowstring, with each of the opposing arms including a safety tab configured to increase an outer diameter of the nock. The arrow is capable of withstanding 400 pounds of force and travel at a velocity of up to 500 fps.

11 Claims, 7 Drawing Sheets

(56) References Cited

U.S. PATENT DOCUMENTS

| | | | | |
|---|---|---|---|---|
| 9,011,280 | B2 * | 4/2015 | Gartland | F42B 6/04 473/578 |
| 9,441,925 | B1 * | 9/2016 | Palomaki | F42B 6/06 |
| 9,546,850 | B2 * | 1/2017 | Boretto | F42B 6/06 |
| 9,631,908 | B2 * | 4/2017 | Park | F42B 6/04 |
| 9,829,291 | B2 * | 11/2017 | Boretto | F42B 6/04 |
| 10,203,187 | B1 * | 2/2019 | Bay | F42B 12/42 |
| 10,254,095 | B1 * | 4/2019 | Wang | F21V 23/06 |
| 10,401,133 | B1 * | 9/2019 | Sullivan | F42B 6/06 |
| 10,655,942 | B2 * | 5/2020 | Schellinger | A01K 81/00 |
| 10,704,873 | B1 * | 7/2020 | Minica | F42B 6/06 |
| 2014/0031153 | A1 * | 1/2014 | Boretto | F42B 6/04 473/586 |
| 2014/0256479 | A1 * | 9/2014 | Bynum, Jr. | F42B 6/08 473/470 |
| 2015/0087450 | A1 * | 3/2015 | Boretto | F42B 6/02 473/578 |
| 2016/0195373 | A1 * | 7/2016 | Barnett | F41B 5/148 124/25 |
| 2017/0097215 | A1 * | 4/2017 | Brown | F42B 6/04 |
| 2017/0234661 | A1 * | 8/2017 | Boretto | F42B 6/04 473/578 |

* cited by examiner

ARROW WITH REDUCED DIAMETER

CROSS-REFERENCE TO RELATED APPLICATIONS

This application claims the benefit of and priority to U.S. Provisional Patent Application No. 62/755,836, filed on Nov. 5, 2018, which is incorporated by reference herein.

SUMMARY OF THE DISCLOSURE

The present disclosure is directed to an arrow having a shaft with a reduced outer diameter that can withstand at least 400 lbs. of force when fired and travel at a velocity of up to 500 feet per second (fps). As used herein, arrow refers both to archery arrows and crossbow bolts. An embodiment of the arrow of the present disclosure may comprise a shaft including a forward section and a rearward section. The shaft may have an outer diameter in the range of 0.231 to 0.274 inches. The arrow may also include a plurality of fletches spaced apart on the outer diameter of the shaft at the rearward section. The arrow may also include a nock partially positioned within the shaft at the rearward section.

In another embodiment of the arrow, the nock may include a pin section extending to a shoulder. The pin section may be dimensioned for insertion within the shaft at the rearward section. The shoulder may be configured for abutment against an end of the rearward section of the shaft. The nock may also include an enlarged section with two opposing arms defining a recess for placement of a bowstring.

In yet another embodiment of the arrow, each of the opposing arms may include a safety tab configured to increase an outer diameter of the nock.

In yet another embodiment of the arrow, each of the opposing arms may include an extension member positioned on an inner side of the arm. Each extension member may be configured to retain the bowstring within the recess.

In yet another embodiment of the arrow, the arrow may further comprise an insert dimensioned for placement within the forward section of the shaft.

In yet another embodiment of the arrow, the arrow may have a weight in the range of 300 to 320 grains.

The present disclosure is also directed to an embodiment of an assembly comprising an arrow having a shaft with a reduced outer diameter and a crossbow track. The crossbow track may include a central track groove. The central track groove may include two upper shoulders. Each of the upper shoulders may have a point of contact for the shaft of the arrow when the arrow is placed in a proper firing position on the crossbow track. A distance between the points of contact may be in a range from 0.154 to 0.207 inches.

In another embodiment of the assembly, the distance between the points of contact maybe about 0.154 inches.

In yet another embodiment of the assembly, the distance between the points of contact may be about 0.207 inches.

The present disclosure is also directed to an embodiment of an alternative assembly comprising an arrow having a shaft with a reduced outer diameter and a crossbow track. The crossbow track may include a central track groove having a center axis. The central track groove may include two upper shoulders. Each of the upper shoulders may have a point of contact for the shaft of the arrow when the arrow is placed in a proper firing position on the crossbow track. An angle of each point of contact in relation to the center axis may be in a range of 47.48 to 42.08.

In another embodiment of the alternative assembly, the angle of each point of contact in relation to the center axis may be about 47.48.

In yet another embodiment of the alternative assembly, the angle of each point of contact in relation to the center axis may be about 42.08.

The present disclosure is also directed to a method of properly positioning an arrow having a reduced outer diameter as described above on a crossbow track assembly for firing. The method may comprise the step of providing a crossbow. The crossbow may include a trigger assembly having a catch. The catch may be configured to retain a bowstring in a cocked position and to release the bowstring upon firing of the crossbow. The catch may include two spaced apart fingers defining a central aperture. The crossbow may also include a crossbow track for placement of an arrow in a firing position. The crossbow track may include a central track groove.

The method may also include the step of placing the bowstring in the cocked position whereby the fingers of the catch retain the bowstring in the cocked position.

The method may also include the step of positioning the arrow on the crossbow track. The arrow may include a shaft having a forward section and a rearward section. The shaft may also include an outer diameter in the range of 0.231 to 0.274 inches. The arrow may also have a plurality of fletches spaced apart on the outer diameter of the shaft at the rearward section. The arrow may also have a nock partially positioned within the shaft at the rearward section. The nock may include a pin section extending to a shoulder. The pin section may be dimensioned for insertion within the shaft at the rearward section. The shoulder may be configured for abutment against an end of the rearward section of the shaft. The nock may also have an enlarged section including two opposing arms defining a recess for placement of the bowstring. Each of the opposing arms may include a safety tab configured to increase an outer diameter of the nock.

The method may also include the step of inserting one of the fletches into the central groove of the crossbow track whereby the two opposing arms of the enlarged section of the nock are placed in vertical alignment relative to the crossbow track.

The method may also include the step of sliding the arrow on the crossbow track in the direction of the catch and causing the nock to move within the central aperture of the catch to receive the bowstring.

In another embodiment of the method, the trigger assembly may further comprise a dry-fire safety mechanism, and the method may further comprise the steps of causing the nock to activate a release of the dry-fire safety mechanism, and releasing the bowstring from the catch whereby the bowstring returns to its uncocked position thereby projecting the arrow in the direction of a target.

The present disclosure is also directed to a further method of properly positioning an arrow on a crossbow track assembly for firing. The further method may comprise the step of providing a crossbow. The crossbow may include a trigger assembly having a catch. The catch may be configured to retain a bowstring in a cocked position and to release the bowstring upon firing of the crossbow. The catch may include two spaced apart fingers defining a central aperture. The crossbow may include a crossbow track for placement of an arrow in a firing position. The crossbow track may include a central track groove having a center axis. The central track groove may include two upper shoulders. Each of the upper shoulders may have a point of contact for a shaft of an arrow when the arrow is placed in a proper firing position on the crossbow track. The shaft of the arrow may have a reduced outer diameter. An angle of each point of contact in relation to the center axis may be in a range of 47.48 to 42.08.

The further method may also include the step of placing the bowstring in the cocked position whereby the fingers of the catch retain the bowstring in the cocked position.

The further method may also include the step of positioning the arrow on the crossbow track. The shaft may include a forward section and a rearward section. A plurality of fletches may be spaced apart on the reduced outer diameter of the shaft at the rearward section. A nock may be partially positioned within the shaft at the rearward section. The nock may include a pin section extending to a shoulder. The pin section may be dimensioned for insertion within the shaft at the rearward section. The shoulder may be configured for abutment against an end of the rearward section of the shaft. The nock may include an enlarged section having two opposing arms defining a recess for placement of the bowstring. Each of the opposing arms may include a safety tab configured to increase an outer diameter of the nock.

The further method may also include the step of inserting one of the fletches into the central groove of the crossbow track whereby the two opposing arms of the enlarged section of the nock are placed in vertical alignment relative to the crossbow track.

The further method may also include the step of sliding the arrow on the crossbow track in the direction of the catch and causing the nock to move within the central aperture of the catch to receive the bowstring.

In another embodiment of the further method, the trigger assembly may further comprise a dry-fire safety mechanism. The further method may further comprise the steps of causing the nock to activate a release of the dry-fire safety mechanism, and releasing the bowstring from the catch whereby the bowstring returns to its uncocked position thereby projecting the arrow in the direction of a target.

DETAILED DESCRIPTION OF THE DISCLOSURE

Figure 1:
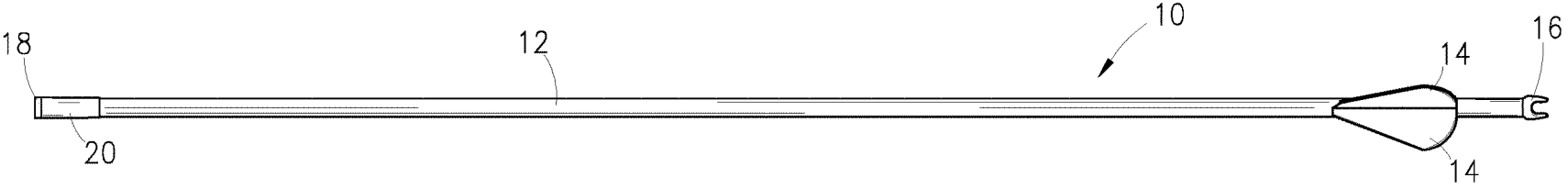
FIG. 1 is a side view of an embodiment of the arrow of the present disclosure.

With reference to the Figures where like elements have been given like numerical designation to facilitate an understanding of the present disclosure, and particularly with reference to the embodiment of arrow 10 illustrated in FIG. 1, arrow 10 may include shaft 12. Shaft 12 may be composed of any suitable material. For example, shaft 12 may be composed of a carbon fiber material such as 24-ton carbon fiber material. Shaft 12 may be tubular and contain a bore (defined by the inner diameter of shaft 12) extending entirely or partially therethrough. For example, the bore in shaft 12 may be contained in the forward section and/or the rearward section thereof. Shaft 12 may have a length of about 21 inches. For example, the length of shaft 12 may be 21 inches±0.04 inches. Shaft 12 may have a reduced outer diameter relative to conventional arrows, and in particular, conventional crossbow arrows or bolts. For example, the outer diameter of shaft 12 may be about 0.273 inches. For example, the OD of shaft 12 may be 0.273 inches±0.001 inches. The inner diameter of shaft 12 may be about 0.204 inches. For example, the ID of shaft 12 may be 0.204 inches±0.001 inches.

With further reference to FIG. 1, arrow 10 may include a plurality of fletches or vanes 14 positioned on the outer surface of shaft 12 at the rearward section thereof. Arrow 10 may also include metal nock 16 positioned at and partially within the rearward end of shaft 12. Arrow 10 may also include insert 18 positioned partially within shaft 12 at the forward section thereof. Arrow 10 may also include outsert 20 positioned at the forward end of shaft 12, partially surrounding the outer surface of shaft 12. Arrow 10 may also contain a field point or broadhead (not shown) detachably affixed to the forward end of shaft 12 by operative connection to insert 18.

Arrow 10 may be configured to withstand about 400 pounds of force. Arrow 10 may be about 300-320 grains in total weight without attachment of a field point or broadhead. Arrow 10 may be about 400-420 grain or about 400 grains in total weight with the attachment of about a 100 grain field point or broadhead. Arrow 10 may be configured to withstand an impact of about 500 fps.

Arrow 10 with attached nock 16 and outsert 20 and/or insert 18 may have a length of about 22 inches. For example, the length of arrow 10 in this configuration may be 22 inches±0.05 inches.

Figure 3:
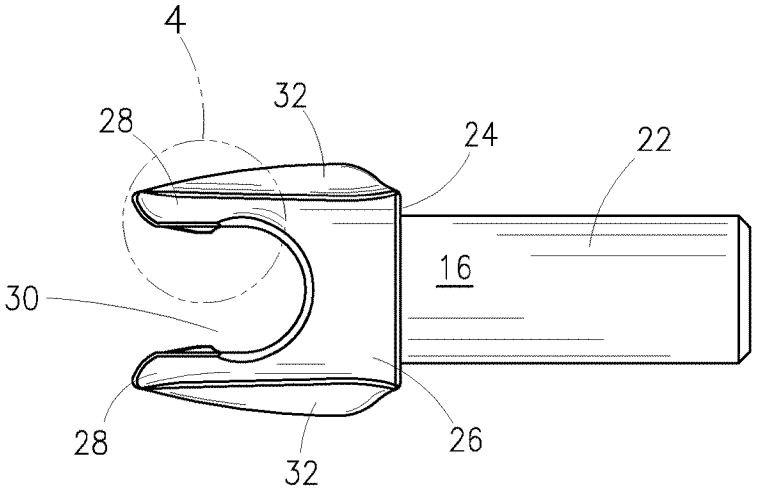
FIG. 3 is a side view of the embodiment of the metal nock of the present disclosure.
Figure 2:
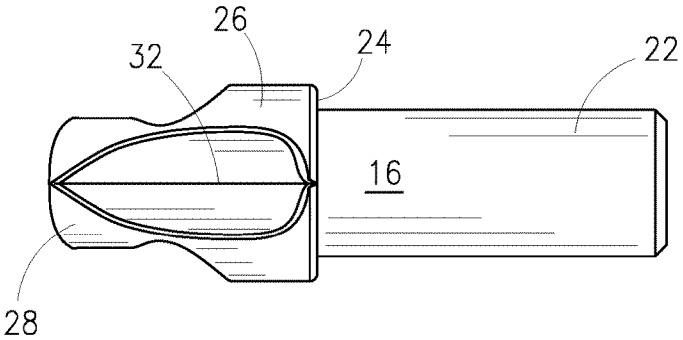
FIG. 2 is a top view of an embodiment of the metal nock of the present disclosure.
Figure 4:
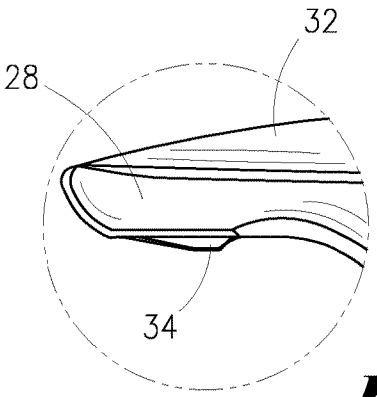
FIG. 4 is a partial side view of the end portion of the embodiment of the metal nock of the present disclosure designated as 4 in FIG. 3.

With reference to FIGS. 2-4, nock 16 may be composed of a metal such as die cast aluminum. The metal composition of nock 16 facilitates the capability of arrow 10 to withstand about 400 lbs of force. Nock 16 may include pin section 22 that may be inserted into the inner diameter of shaft 12 for operative connection of nock 16 to the rearward end of shaft 12. Pin section 22 may have a length of about 0.471 inches. For example, the length of pin section 22 may be 0.471 inches±0.01 inches. Pin section 22 may have an outer diameter of about 0.204 inches. For example, the OD of pin section 22 may be 0.204 inches±0.001 inches. Shoulder 24 abuts against the rearward end of shaft 12 when nock 16 is in operative connection with shaft 12. Nock 16 may contain enlarged section 26 that is external to shaft 12 in the operative position. Enlarged section 26 may include two arms 28 that define recess 30. Recess 30 may be configured to accommodate the bowstring (not shown) when arrow 10 is operatively placed in the firing position on, for example, a crossbow. Each of arms 28 may include safety tabs 32 that extend or increase the outer diameter of enlarged section 26.

As seen in FIG. 4, arms 28 may each contain extension member 34 configured to retain the bowstring within recess 30 when arrow 10 is in the firing position. Arms 28 of nock 16 containing safety tabs 32 may have an outer diameter that approximates the outer diameter as standard nocks used with larger-sized arrows. The outer diameter of nock 16 at safety tabs 32 may be about 0.350 inches. For example, the OD of nock 16 at safety tabs 32 may be 0.350 inches±0.01 inches. The outer diameter of nock 16 at the sections between arms 28 may be about 0.273 inches. For example, the OD of nock 16 at the section between arms 28 may be 0.273 inches±0.002 inches. Nock 16 may have a weight of about 13.6 grains. For example, the weight of nock 16 may be 13.6 grains±0.05 grains.

Figure 5:
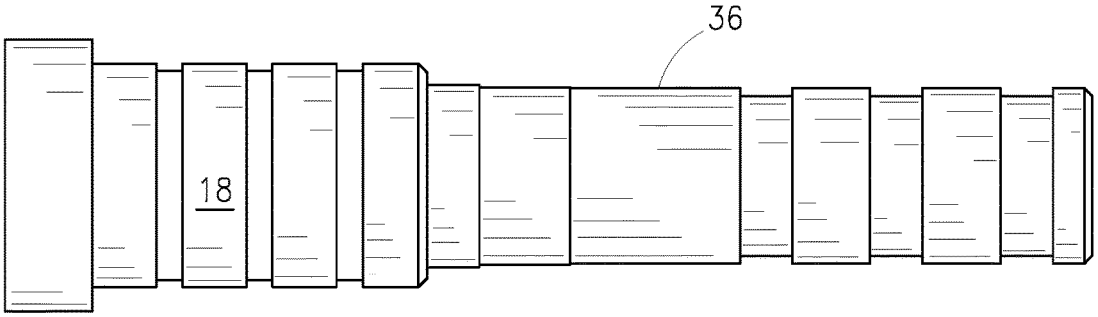
FIG. 5 is a side view of an embodiment of the insert of the present disclosure.
Figure 7:
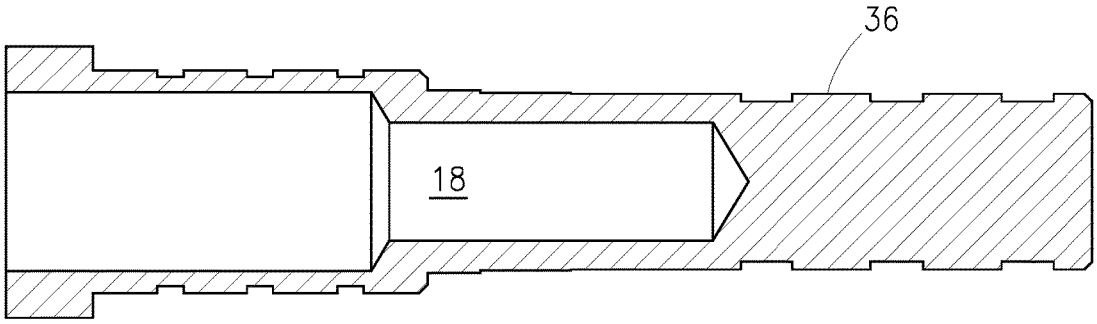
FIG. 7 is a cross-sectional view of the embodiment of the insert of the present disclosure taken along lines 7-7 of FIG. 6.
Figure 6:
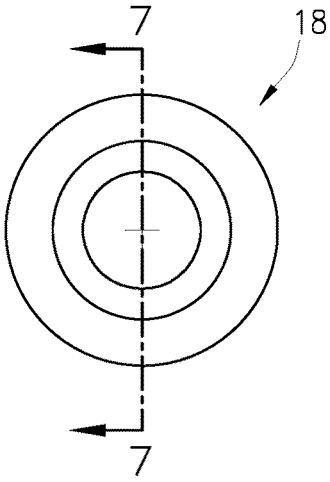
FIG. 6 is a front view of the embodiment of the insert of the present disclosure.

FIGS. 5 and 6 depict insert 18. Insert 18 may be composed of aluminum. Insert 18 may have a weight of about 48.5 grains. For example, the weight of insert 18 may be 48.5 grains±0.05 grains. Insert 18 may be configured for placement within the forward section of shaft 12. For example, insert 18 may include section 36 that is operatively positioned within shaft 12 at its forward end and glued in place therein. Section 36 may have an outer diameter of about 0.204 inches. For example, the OD of section 36 may be 0.204 inches+0.005 inches, −0.013 inches. Insert 18 may have an extended length of about 2.5 inches. For example, the length of insert 18 may be 2.5 inches±0.01 inches. The extended length of insert 18 causes insert 18 to have an increased weight (about an additional 20 grains relative to conventional inserts) which offsets the reduced weight of the reduced diameter shaft 12 so that arrow 10 (with field point or broadhead attached) achieves a total overall weight of about 400-420 grains or, for example, 400 grains. Furthermore, the added weight at the front end of the arrow 10 caused by elongated insert 18, also achieves an improved balance point to make up for the added weight of the metal nock 16 at the rearward end of arrow 10. The weight-forward design of arrow 10 achieves a more accurate and true flight trajectory relative to centered-balanced arrows that have a greater tendency to drift away from the aiming point.

Figure 9:
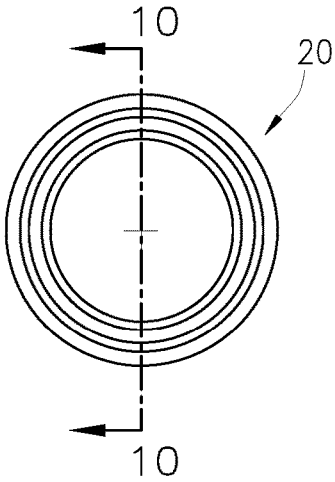
FIG. 9 is a front view of the embodiment of the outsert of the present disclosure.
Figure 10:
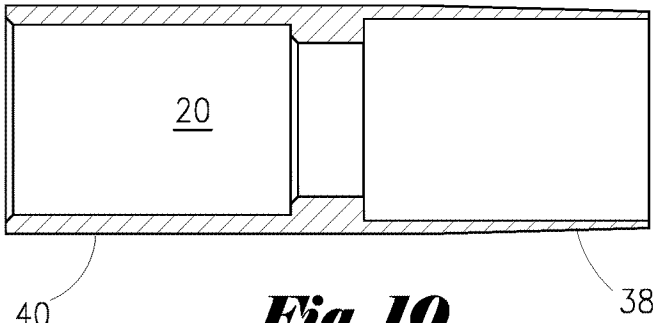
FIG. 10 is a cross-sectional view of the embodiment of the outsert of the present disclosure taken along lines 10-10 of FIG. 9.
Figure 8:
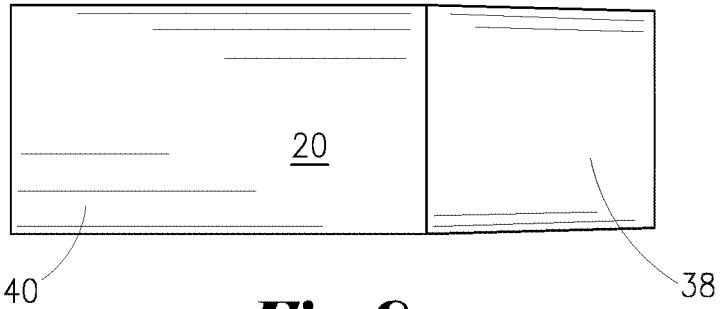
FIG. 8 is a side view of an embodiment of the outsert of the present disclosure.
Figure 11:
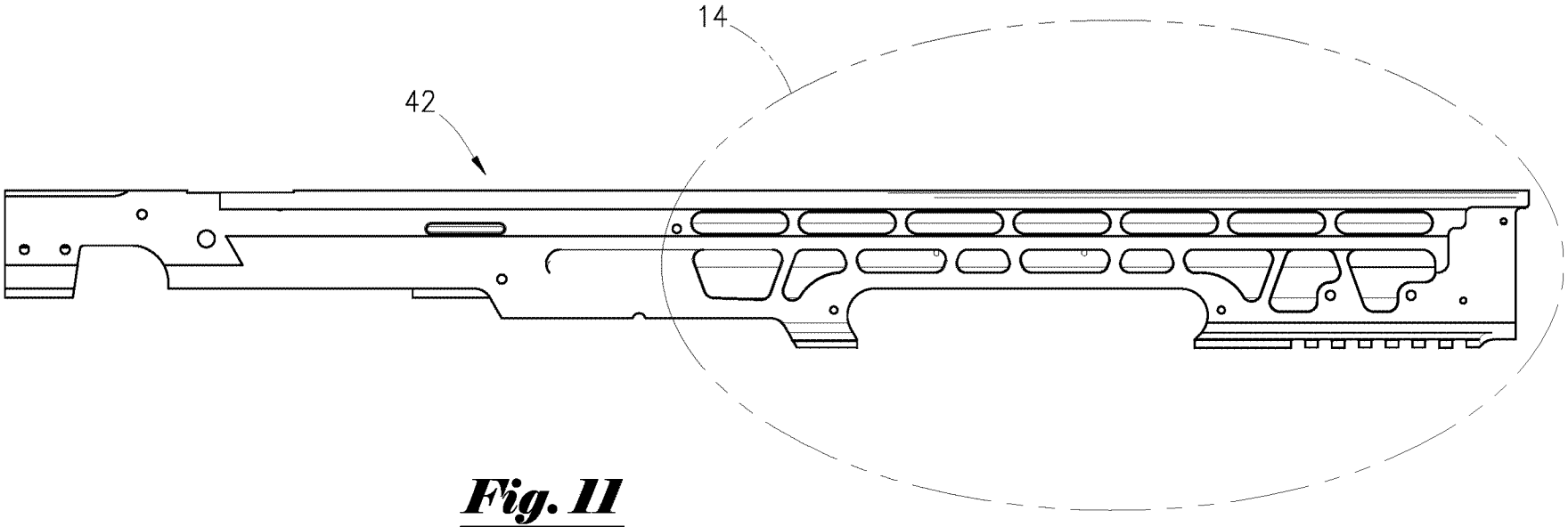
FIG. 11 is a side view of an embodiment of the track assembly of the present disclosure.
Figure 12:
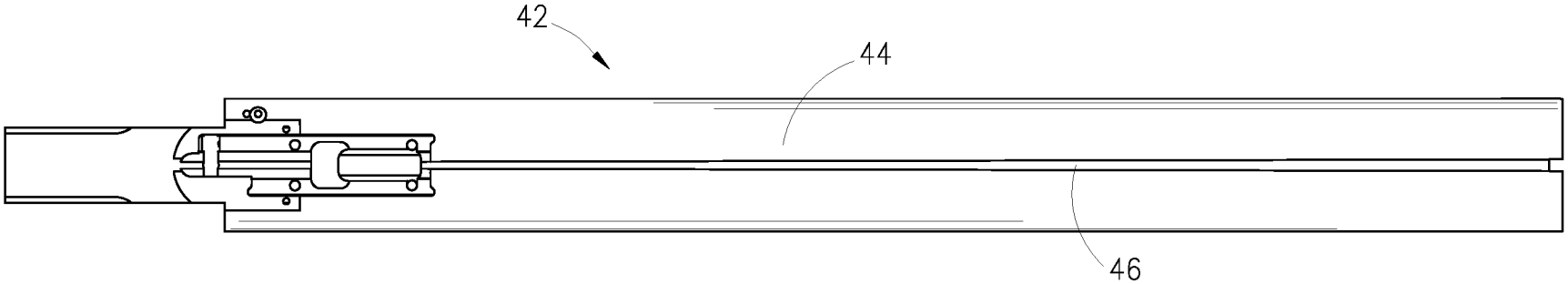
FIG. 12 is a top view of the embodiment of the track assembly of the present disclosure.
Figure 13:
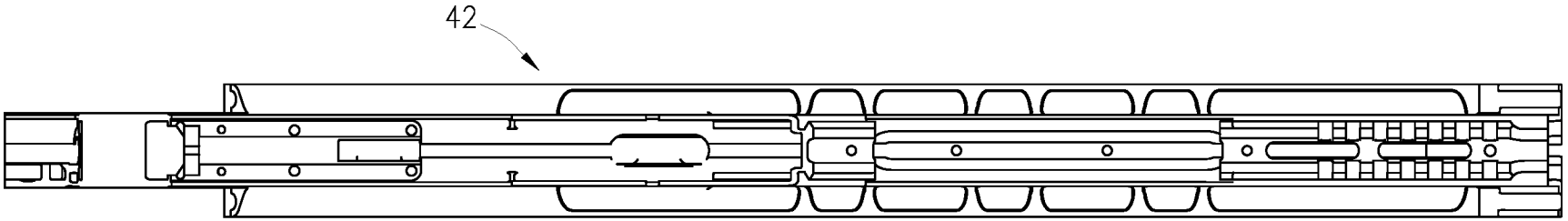
FIG. 13 is a bottom view of the embodiment of the track assembly of the present disclosure.
Figure 14:
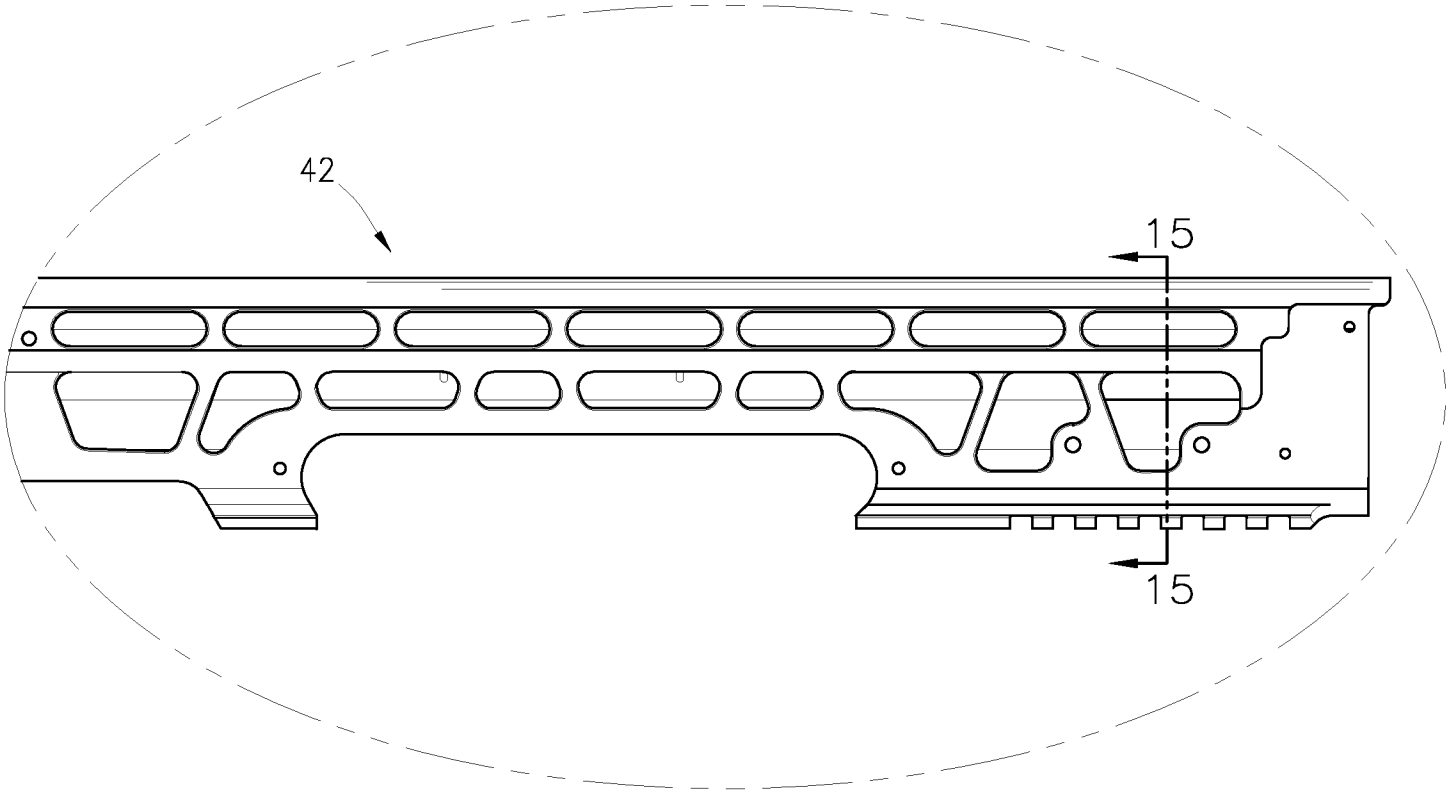
FIG. 14 is a partial side view of the embodiment of the track assembly of the present disclosure designated as 14 in FIG. 11.
Figure 15:
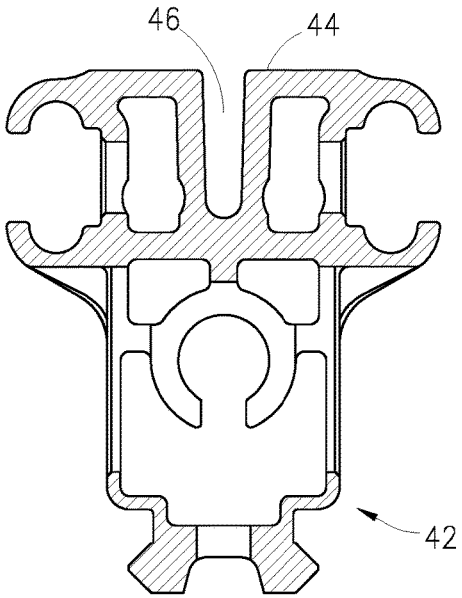
FIG. 15 is a cross-sectional view of the embodiment of the track assembly of the present disclosure taken along lines 15-15 of FIG. 14.

With reference to FIGS. 8-10, outsert 20 may contain front section 38 and rear section 40. Rear section 40 may be configured to accommodate the outer surface of the forward end of shaft 12 and may be glued in place thereon. Front section 38 may be configured to accommodate insert 18. The inner diameter of rear section 40 may be about 0.276 inches to accommodate the outer diameter of shaft 12. For example, the ID of rear section 40 may be 0.276 inches±0.001 inches. The inner diameter of front section 38 may be about 0.260 inches to accommodate insert 18. For example, the ID of front section 38 may be 0.260 inches±0.001 inches. Outsert 20 may have a length of about 0.880 inches. For example, the length of outsert 20 may be 0.880 inches±0.01 inches. Outsert 20 may be made of aluminum.

FIGS. 11-15 illustrate track assembly 42. Track assembly 42 may be operatively affixed to the upper or top side of a crossbow stock or barrel. Track assembly 42 may include track 44 configured to provide a launching platform for arrow 10. The width of track 44 may be configured to accommodate the reduced diameter shaft 12. For example, the width of track 44 may be narrowed relative to conventional tracks firing larger-sized arrows to account for the lift arrow 10 needs to remain in the center of string and provide firing and flight accuracy.

Arrow 10 must be able to fit on and be supported by track groove 46 as it travels down track 44 during firing. Track groove 46 may have a width of about 0.186 inches so that arrow 10, namely shaft 12, is operatively positioned over and supported by track groove 46 for proper firing of arrow 10. The depth of track groove 46 may vary. For example, the depth of track groove 46 may depend on the size of vane 14, which must be accommodated within track groove 46 for proper firing placement of arrow 10.

Figure 16:
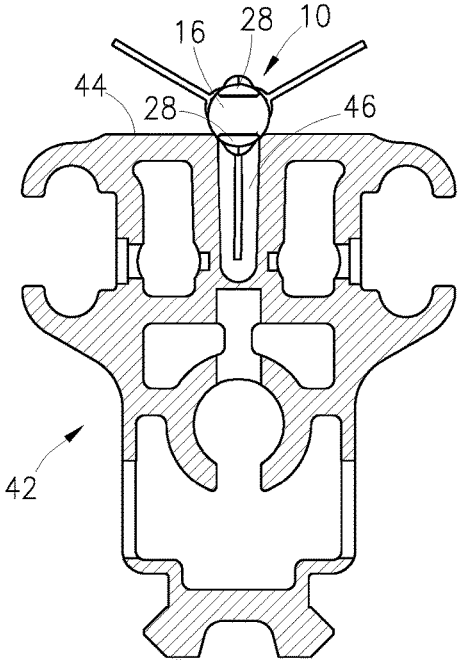
FIG. 16 is a partial rearward view of the embodiment of the track assembly of the present disclosure with an embodiment of the arrow of the present disclosure positioned thereon.

FIG. 16 shows arrow 10 situated on track 44 in the firing position. Arms 28 of nock 16 are correctly aligned vertically such that a vane 14 is properly positioned within track groove 46. As mentioned above, the reduced width of track groove 46 supports and aligns arrow 10 properly on track 44 in the firing position.

Figure 17:
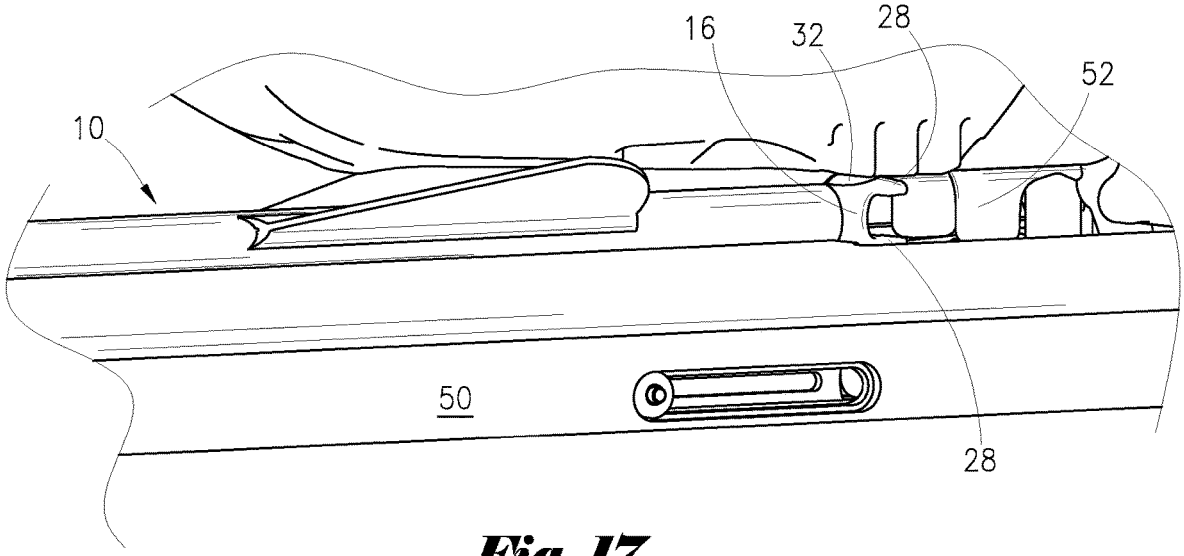
FIG. 17 is a perspective view depicting the placement of the embodiment of the metal nock of the present disclosure about the latch of a trigger assembly.
Figure 18:
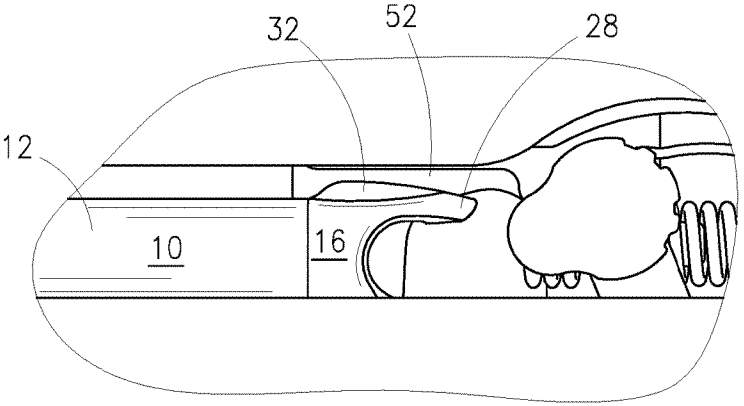
FIG. 18 is a side view of the embodiment of the metal nock of the present disclosure placed within the latch of the trigger assembly.

FIG. 17 depicts the insertion of arrow 10 into the firing position on crossbow 50. The trigger assembly of crossbow 50 includes latch or catch 52, which in the position shown in the FIG. 17 will retain the bowstring (not shown) in the cocked position. The user of the crossbow will move the arrow 10 along the track 44 towards latch 52 until nock 16 contacts the bowstring in the cocked position. The user will push or move arrow 10 such that arms 28 of nock 16 are placed over the bowstring, with the bowstring being accommodated within recess 30 of nock 16. The user will then activate the trigger to cause rotation or pivoting of latch 52 thereby releasing and firing the bowstring. Rapid movement of the bowstring from the cocked to the fired position (bowstring returns to its uncocked position near the forward end of the stock) will cause arrow 10 to travel along track 44 in the direction of the forward end of crossbow 50 and into its flight trajectory.

Safety tabs 32 on each of arms 28 prevent access of arrow 10 (i.e., nock 16) into latch 52 and onto the bowstring unless arrow 10 is properly in position on track 44. Arrow 10 is properly positioned on track 44 when arms 28 of nock 16 are in vertical alignment and a vane 14 is accommodated within track groove 46 as shown in FIGS. 16 and 17. In this position, nock 16 is capable of being placed within latch 52 and onto the bowstring. If arrow 10 is not in proper position on track 44 and arms 28 of nock 16 are not vertically aligned with a vane 14 situated within track groove 46 (as for example, when arms 28 are in horizontal alignment (or other than vertical alignment)), the outer diameter of nock 16 is too large to be inserted within or through latch 52 due to the extended outer diameter caused by safety tabs 32. Thus, nock 16 provides a mechanism to ensure proper placement and positioning of arrow 10 in the firing position within the trigger assembly. If crossbow 50 is equipped with a dry-fire safety mechanism, crossbow 50 may only be fired when nock 16 is properly placed within latch 52 and activates a release to permit firing. The configuration of nock 16 therefore provides a further means to restrict dry firing of crossbow 50.

Figure 19:
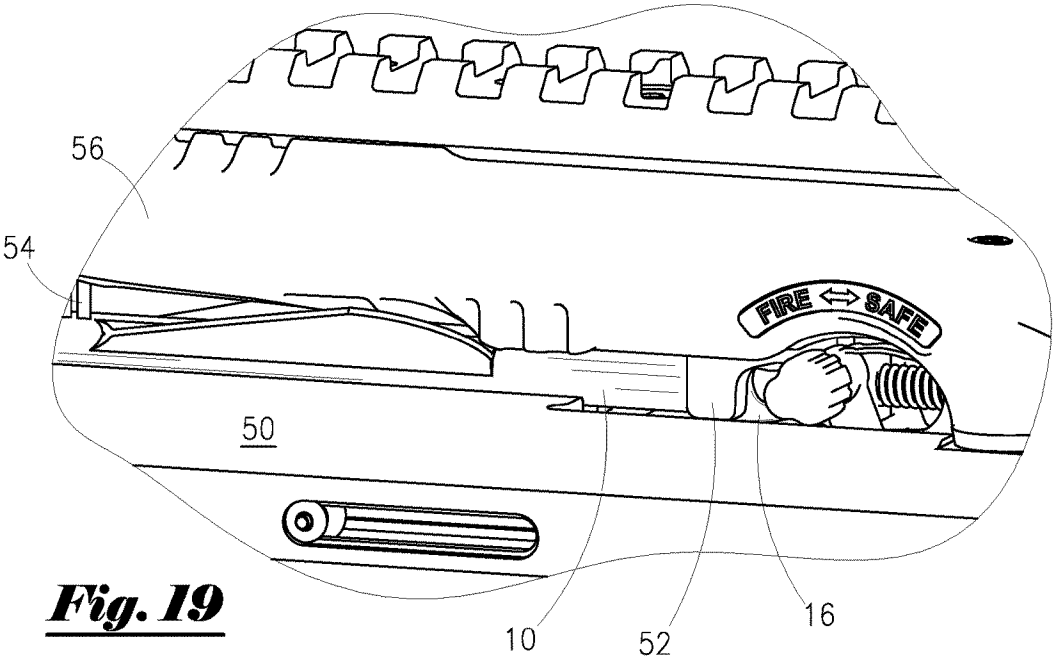
FIG. 19 is a perspective view of the embodiment of the metal nock of the present disclosure placed within the latch of the trigger assembly in the firing position.

With reference to FIG. 19, if the user incorrectly places arrow 10 upside down whereby arms 28 of nock 16 are vertically aligned (but in the opposite direction) and able to be placed within latch 52, the configuration of arrow 10 places vane 14 (that otherwise would be within track groove 46), in an upward position whereby vane 14 will contact bristles 54 extending downward from hood 56 of crossbow 50 thereby signifying to the user that arrow 10 is incorrectly positioned on track 44.

While preferred embodiments of the present disclosure have been described, it is to be understood that the embodiments described are illustrative only and that the scope of the disclosure is to be defined solely by the appended claims when accorded a full range of equivalents, many variations and modifications naturally occurring to those skilled in the art from a perusal hereof.

What is claimed is:

1. An arrow comprising:

a shaft including a forward section and a rearward section, the shaft including an outer diameter in the range of 0.231 to 0.274 inches, the shaft configured for direct placement upon a crossbow track when in a firing position, the shaft not including a circumferential spacer positioned thereon;

a plurality of fletches spaced apart on the outer diameter of the shaft at the rearward section;

a nock partially positioned within the shaft at the rearward section, the nock including:

a pin section extending to a shoulder, the pin section dimensioned for insertion within the shaft at the rearward section, the shoulder configured for abutment against an end of the rearward section of the shaft; and an enlarged section including two opposing arms defining a recess for placement of a bowstring, each of the opposing arms extending from the shoulder and terminating at a tip; each of the opposing arms including a safety tab configured to increase an outer diameter of the nock, each safety tab including an upper surface tapering from a high point proximate to the shoulder and terminating at a low point at the tip, the outer diameter of the nock is larger at the high points of the safety tabs and smaller at the low points of the safety tabs.

2. The arrow of claim 1, wherein each of the opposing arms includes an extension member positioned on an inner side of the arm, each extension member configured to retain the bowstring within the recess.

3. The arrow of claim 1, further comprising an insert dimensioned for placement within the forward section of the shaft.

4. The arrow of claim 3, wherein the insert has a length of approximately 2.5 inches.

5. The arrow of claim 4, wherein the insert has a weight of approximately 48.5 grains.

6. The arrow of claim 1, further comprising an outsert dimensioned for partial placement around the outer diameter of the shalt at the forward section.

7. The arrow of claim 6, wherein the outsert includes a front section having an internal bore and a rear section having an internal bore, the internal bore of the rear section dimensioned for placement around the outer diameter of the shaft at the forward section, the internal bore of the front section dimensioned to receive an insert.

8. The arrow of claim 1, wherein the nock is made of a metal.

9. The arrow of claim 8, wherein the metal is a die cast aluminum.

10. The arrow of claim 8, wherein the outer diameter of the shaft is approximately 0.273 inches.

11. The arrow of claim 1, wherein the outer diameter of the nock at the high points of the safety tabs is approximately 0.350 inches and the outer diameter of the nock at a section between the arms is approximately 0.273 inches.

* * * * *